US009062529B2

(12) United States Patent
Ellis et al.

(10) Patent No.: US 9,062,529 B2
(45) Date of Patent: Jun. 23, 2015

(54) GRAVEL PACK ASSEMBLY AND METHOD OF USE

(75) Inventors: Jason Ellis, Houston, TX (US); Joe Bob Maddox, Lafayette, LA (US); Lance Alan Lee, Youngsville, LA (US); Harris Guldry, II, Lafayette, LA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 555 days.

(21) Appl. No.: 13/297,129

(22) Filed: Nov. 15, 2011

(65) Prior Publication Data

US 2013/0118738 A1 May 16, 2013

(51) Int. Cl.
*E21B 43/04* (2006.01)

(52) U.S. Cl.
CPC ..... *E21B 43/04* (2013.01)

(58) Field of Classification Search
CPC ..... E21B 43/04
USPC ..... 166/278, 51, 276
See application file for complete search history.

(56) References Cited

U.S. PATENT DOCUMENTS

| | | | | |
|---|---|---|---|---|
| 1,707,072 | A | | 3/1929 | Black |
| 3,602,307 | A | | 8/1971 | Price et al. |
| 4,856,590 | A | | 8/1989 | Caillier |
| 4,860,831 | A | | 8/1989 | Caillier |
| 5,033,549 | A | | 7/1991 | Champeaux et al. |
| 5,597,040 | A | * | 1/1997 | Stout et al. ..... 166/51 |
| 5,722,490 | A | | 3/1998 | Ebinger |
| 5,975,205 | A | | 11/1999 | Carisella |
| 6,176,307 | B1 | | 1/2001 | Danos et al. |
| 6,230,802 | B1 | | 5/2001 | Duhon |
| 6,408,945 | B1 | | 6/2002 | Telfer |
| 6,601,648 | B2 | | 8/2003 | Ebinger |
| 6,763,885 | B2 | | 7/2004 | Cavender |
| 6,851,474 | B2 | | 2/2005 | Nguyen |
| 2002/0062960 | A1 | | 5/2002 | George et al. |
| 2003/0075326 | A1 | | 4/2003 | Ebinger |
| 2004/0154796 | A1 | | 8/2004 | Nguyen |
| 2004/0262005 | A1 | | 12/2004 | Harmon et al. |
| 2005/0034859 | A1 | | 2/2005 | Caillier |
| 2010/0025037 | A1 | | 2/2010 | Tibbles |

OTHER PUBLICATIONS

PCT International Search Report and Written Opinion for International Application No. PCT/US2012/065321, dated Apr. 9, 2014.
PCT Partial International Search for International Application No. PCT/US2012/065321 dated Dec. 17, 2013.

* cited by examiner

*Primary Examiner* — Jennifer H Gay
*Assistant Examiner* — Steven MacDonald
(74) *Attorney, Agent, or Firm* — Patterson & Sheridan, L.L.P.

(57) ABSTRACT

A method of conducting a gravel pack operation comprising lowering a fluid control assembly into a wellbore and supplying a fluid mixture comprising gravel into an annulus between the fluid control assembly and the wellbore to form a gravel pack. A washout assembly surrounds a pre-determined length of the fluid control assembly to remove gravel pack from around the predetermined length. A tattle-tale sub provides an indication of the location of the washout assembly relative to the fluid control assembly. The placement of a cement or inflatable packer is controlled relative to the pre-determined length of the fluid control assembly.

23 Claims, 7 Drawing Sheets

GRAVEL PACK ASSEMBLY AND METHOD OF USE

BACKGROUND OF THE INVENTION

1. Field of the Invention

Embodiments of the invention relate to thru-tubing gravel pack operations. Embodiments of the invention relate to apparatus and methods of installing a fluid control assembly in a wellbore. Embodiments of the invention relate to apparatus and methods of securing gravel packs in wellbores using cement packers or other similar types of packers/plugs.

2. Description of the Related Art

In many oil and gas wells, sand from the reservoir may enter the wellbore during well production. The sand may flow into the wellbore annulus with the recovered hydrocarbons and cause numerous abrasive problems to the well screens, production tubing, and other associate equipment. One method of sand control is the use of a gravel pack, which is a gravel filled portion of the wellbore that functions as a filter to prevent sand from being carried into the wellbore from the reservoir.

Generally, gravel packs have an open upper end and are not fully contained. High pressure differentials within the wellbore and high production flow rates can cause the gravel packs to move around and shift, thereby opening spaces within the gravel pack and making it easier for sand to migrate through. Therefore, cement or inflatable packers have been used to secure the gravel packs within the wellbore. However, there are many problems associated with the use of both types of packers. For example, controlling the amount and placement of cement above the gravel pack without plugging up the production equipment has been a difficult task. Inflatable packers often provide inadequate sealing due to the restricted diameters available for lowering the packer into the wellbore and the large diameter seal needed for securing the gravel pack therein.

Therefore, there is a need for new and improved apparatus and methods for use with gravel pack operations.

SUMMARY OF THE INVENTION

In one embodiment, a method of conducting a gravel pack operation comprises lowering a fluid control assembly into a wellbore; supplying a fluid mixture comprising gravel into an annulus between the fluid control assembly and the wellbore to form a gravel pack; lowering a washout assembly into the wellbore, wherein the washout assembly surrounds a predetermined length of the fluid control assembly; removing the gravel pack from around the predetermined length of the fluid control assembly using the washout assembly; and securing the gravel pack in the wellbore using a packer.

In one embodiment, a method of conducting a gravel pack operation comprises lowering a fluid control assembly into a wellbore; supplying a fluid mixture comprising gravel into an annulus between the fluid control assembly and the wellbore to form a gravel pack; lowering a washout assembly into the wellbore and into engagement with the fluid control assembly; actuating an indication member of the washout assembly to indicate the engagement of the washout assembly with the fluid control assembly; removing a portion of the gravel pack from around the fluid control assembly using the washout assembly; and securing the gravel pack in the wellbore using a packer.

In one embodiment, a wellbore system comprises a fluid control assembly; and a washout assembly having a tattle-tale sub with a flow bore disposed therein, and having an indication member releasably coupled to the tattle-tale sub, wherein fluid flow through the flow bore is obstructed when the indication member is moved into engagement with the fluid control assembly, and wherein the indication member is releasable from the tattle-tale sub when forced into engagement with the fluid control assembly.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
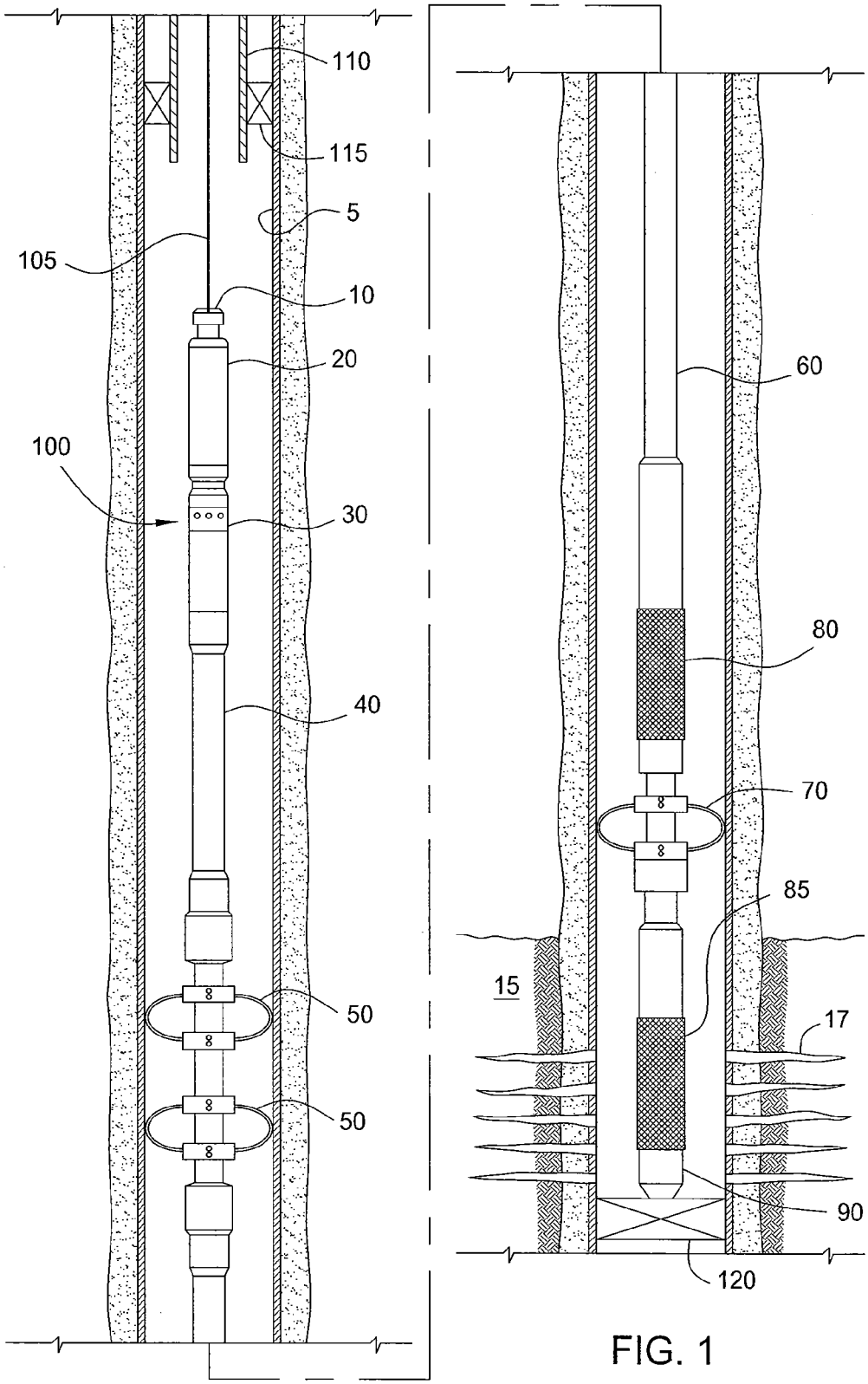
FIG. 1 illustrates a fluid control assembly for recovering fluids from a wellbore.

FIG. 1 illustrates a wellbore 5 formed through a reservoir 15. The wellbore 5 may be an open hole or reinforced with one or more casings. The wellbore 5 may also be perforated with one or more perforations 17 using methods known in the art for access to fluids within the reservoir 15. Reservoir fluids may be recovered to the surface through a tubing string 110, which may be secured in the wellbore 5 by a packer 115 or other similar anchoring/sealing member.

A fluid control assembly 100 may be used to facilitate recovery of fluids from the reservoir 15. The fluid control assembly 100 may be lowered through the tubing string 110 using a conveyance member 105, such as a jointed or coiled tubing string, a slickline, or a wireline. The fluid control assembly 100 may be lowered into the wellbore 5 and landed or set down on a bottom surface 120, which may be the bottom of the wellbore 5 or a packer/plug type member. The formation of the wellbore 5, the location of the bottom surface 120, and/or the dimensions of the fluid control assembly 100 may be arranged so that the fluid control assembly 100 is positioned adjacent or close to the perforations 17 when located in the wellbore 5. A gravel pack, further described below, may be supplied through the tubing string 110 to fill in the annulus between the fluid control assembly 100 and the wellbore 5. The gravel pack and the fluid control assembly 100 are operable to filter out particulate matter, such as sand and other debris, from the fluids recovered from the reservoir 15 to prevent damage and/or obstruction of the tubing string 110 and other downhole equipment.

The fluid control assembly 100 may include a connection member 10, a fill sub 20, a disconnection member 30, one or more blank tubing members 40, 60, one or more centralizers 50, 70, one or more screen members 80, 85, and a guide member 90. Some of the components of the fluid control assembly 100 may include tubular members with flow bores disposed therein. In one embodiment, fluid may flow into the fluid control assembly 100 through the screen members 80, 85, may flow through the flow bore of the fluid control assembly 100, and may flow out of the fluid control assembly 100 through the fill sub 20. The flow bore of the fluid control assembly 100 may facilitate run-in of the assembly into the wellbore 5.

The connection member 10 may include a tubular or other type of member for coupling to the conveyance member 105 on one end, and coupling to the fill sub 20 at the opposite end. The connection member 10 may be releasably coupled to the conveyance member 105, and may be operable for engagement with a retrieval tool for removal from the wellbore 5. In one embodiment, the connection member 10 may be a cable head assembly. In one embodiment, the connection member 10 may include a fish-neck profile for retrieval from the wellbore 5.

Figure 6:
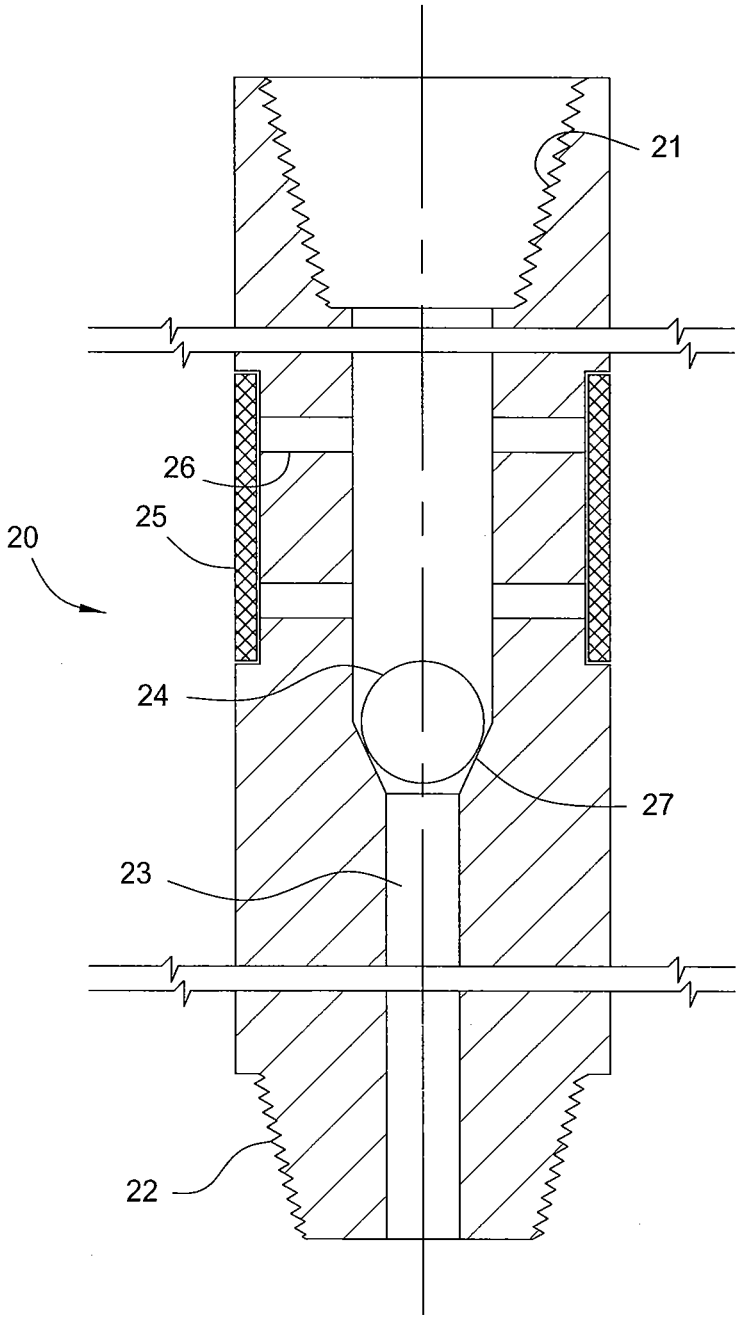
FIG. 6 illustrates a sectional view of a fill sub of the fluid control assembly.

The fill sub 20 is illustrated in FIG. 6, and includes a tubular member having a flow bore 23 therein. Upper and lower threads 21, 22 are provided for coupling to the connection member 10 and the disconnection member 30, respectively, although other connection arrangements may be used. A ball member 24 and a ball seat 27 are arranged to permit fluid flow through the flow bore 23 in one direction, while preventing fluid flow in the opposite direction. Other types of one-way valves, or check valves, may similarly be used. In one embodiment, the fill sub 20 may be operable to permit fluid communication through the flow bore 23 in both directions. For example, the ball member 24 may be pumped through the ball seat 27, or the ball seat 27 may be releasably coupled to the fill sub 20 so that the fill sub 20 can be converted from a one-way valve to an open valve with fluid flow in both directions. One or more ports 26 intersect the flow bore 23 to communicate fluid between the flow bore 23 and the annulus surrounding the fill sub 20. One or more filter members 25 are provided to filter fluid that flows into and/or out of the fill sub 20 via the ports 26. During run-in and/or operation of the fluid control assembly 100, fluid may flow into the screen members 80, 85 and out through the fill sub 20. Fluid flow in the opposite direction, such as from the surface, will force the ball member 24 against the ball seat 27 to close fluid communication through the fluid control assembly 100. Alternatively, or in addition to the fill sub 20, the fluid control assembly 100 may include another screen member, such as screen members 80, 85.

Referring back to FIG. 1, the fluid control assembly 100 is positioned in the wellbore 5 adjacent the perforations 17 and the reservoir 15. The guide member 90 may direct the fluid control assembly 100 during run-in, and may be used to safely land the fluid control assembly 100 on the bottom surface 120. In one embodiment, the guide member 90 may include a bull plug. The centralizers 50, 70 may be operable to maintain the fluid control assembly 100 in a substantially central position within the wellbore 5 during run-in and/or when landed on the bottom surface 120. In one embodiment, the centralizers 50, 70 may include bow springs or may be radially actuated members for engagement with the walls of the tubing string 110 and/or the wellbore 5 to centralize the fluid control assembly 100. The blank tubing members 40, 60 may be used to accurately space the components of the fluid control assembly 100 relative to each other and/or for accurate placement of one or more components, such as the screen members 80, 85, relative to the reservoir 15 when the fluid control assembly 100 is located in the wellbore 5. The screen members 80, 85 may be operable to filter out particular matter or other intrusive debris from reservoir 15 and/or wellbore 5 fluids. After the fluid control assembly 100 is positioned in the wellbore 5, the conveyance member 105 may be released from the assembly 110 and may be retrieved to the surface. In one embodiment, the conveyance member 10 may be released from its connection to the connection member 10 by rotational disconnect, hydraulic or mechanical shear, jarring disconnect, and/or other types of release mechanisms known in the art.

Figure 2:
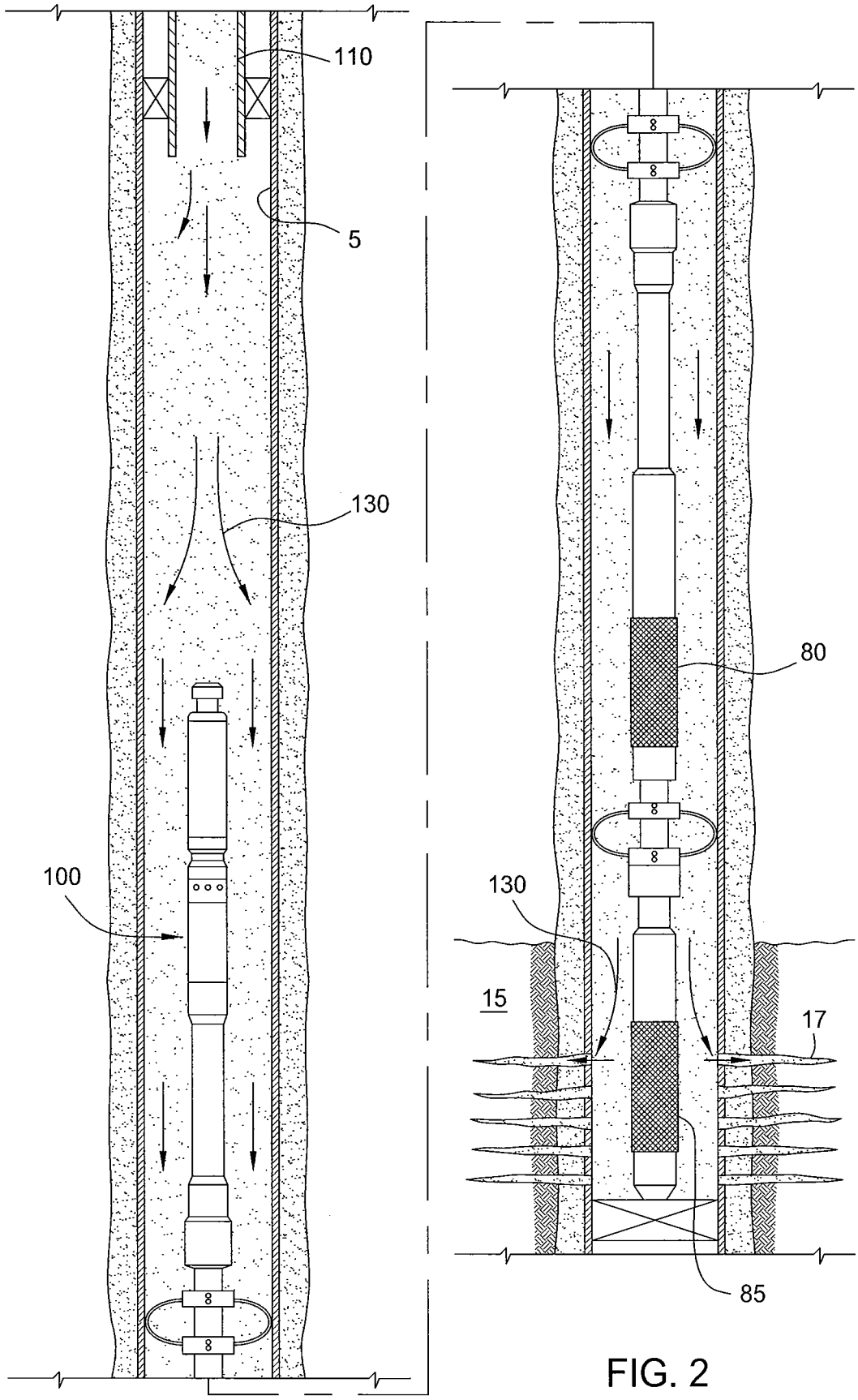
FIG. 2 illustrates a gravel pack operation performed in the wellbore.

FIG. 2 illustrates a gravel pack operation. A fluid mixture 130 comprising gravel to form a gravel pack may be supplied through the tubing string 110 to fill in the annulus between the fluid control assembly 100 and the wellbore 5. The fluid mixture 130 may flow into the reservoir 15 via the perforations 17. A predetermined amount of the fluid mixture 130 may be supplied to the wellbore 5, and/or may be supplied for a predetermined amount of time. In one embodiment, the fluid mixture 130 may be supplied until a screen out occurs. A screen out may occur when it is no longer safe due to pressure constraints to continue pumping the fluid mixture 130 into the wellbore 5. Excess fluid mixture 130 in the wellbore and/or in the tubing string 110 may be pumped out to the surface.

Figure 3:
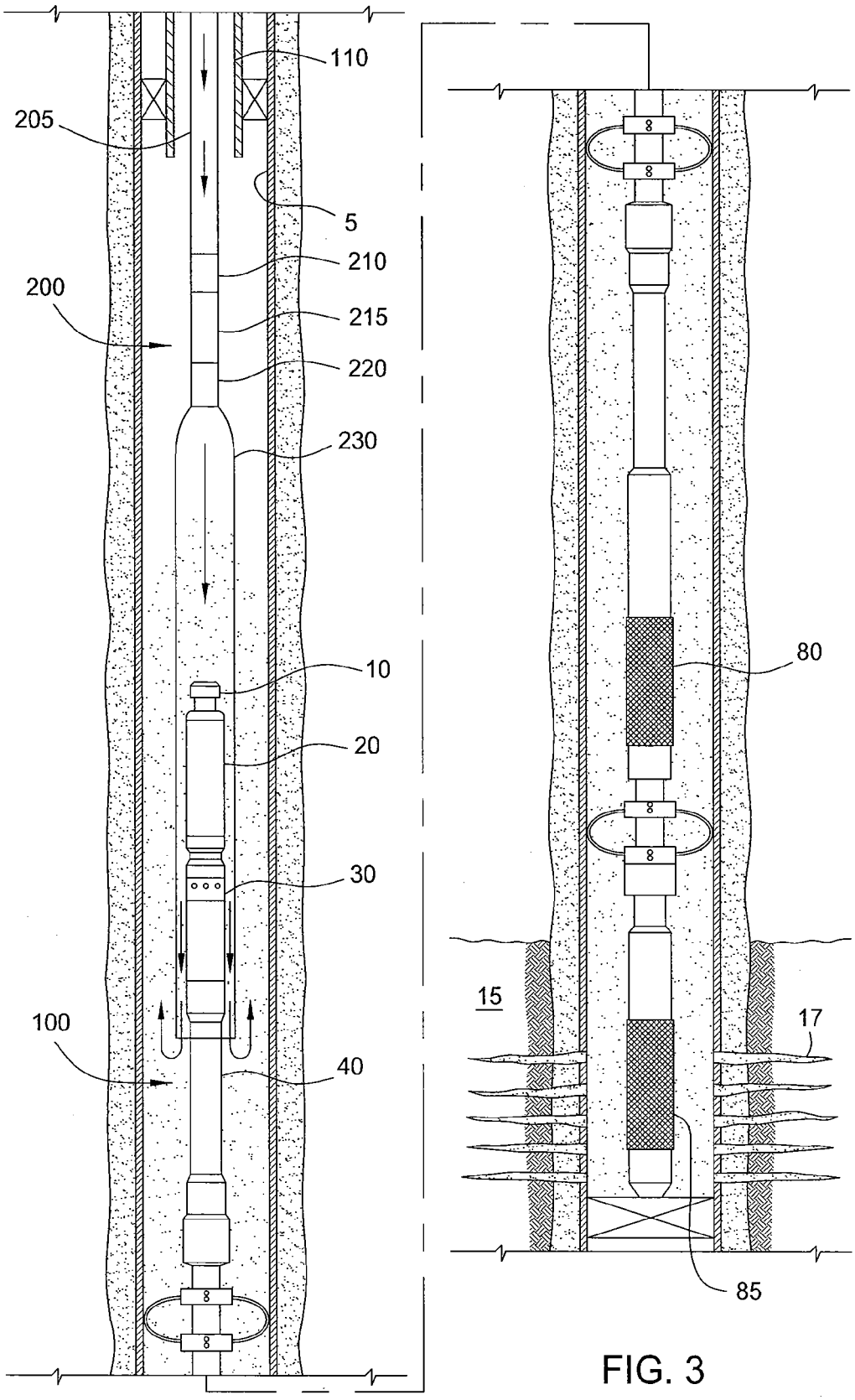
FIG. 3 illustrates a washout assembly for performing a washout operation in the wellbore.

FIG. 3 illustrates a washout assembly 200 for conducting a washout operation. After the gravel pack is set around the fluid control assembly 100, the washout assembly 200 may be lowered through the tubing string 110 via a conveyance member 205 to remove excess gravel pack from around the upper portion of the fluid control assembly 100. In one embodiment, the conveyance member 205 may include a jointed or coiled tubing string. The washout assembly 200 may include a connection member 210, an optional motor assembly 215, a tattle-tale sub 220, and a washout sub 230. The components of the washout assembly 200 may include tubular members having flow bores disposed therein. The connection member 210 may provide coupling of the washout assembly 200 to the conveyance member 205 via a threaded engagement or other similar connection mechanism. The optional motor assembly 215 may provide rotation of the washout sub 230 to assist in the removal and/or washout of the gravel pack from the wellbore 5. In one embodiment, the motor assembly 215 may be actuated by fluid flow through the washout assembly 200. The tattle-tale sub 220 may be operable to provide an indication that the washout assembly 200 is lowered to the appropriate location with respect to the fluid control assembly 100 during the washout operation. The washout sub 230 may be configured to surround and fully enclose the upper end of the fluid control assembly 100 and direct pressurized fluid into the wellbore 5 to washout the desired amount of gravel pack. In one embodiment, a centralizer may be used to maintain the washout sub 230 in central alignment with the wellbore 5 and the fluid control assembly 100.

Figure 7:
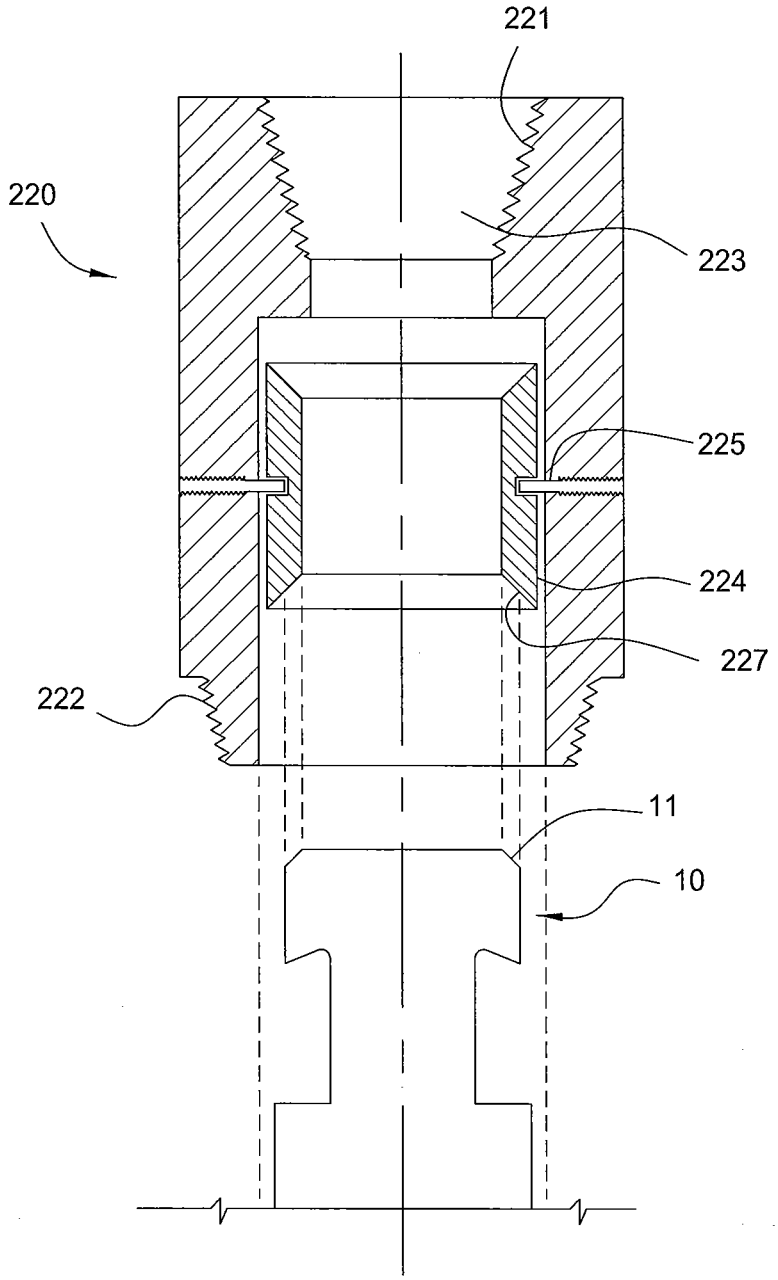
FIG. 7 illustrates a sectional view of a tattle-tale sub of the fluid control assembly.

The tattle-tale sub 220 is illustrated in FIG. 7, and includes a tubular member having a flow bore 223 therein. Upper and lower threads 221, 222 are provided for coupling to the motor assembly 215 and/or the connection member 210 and the washout sub 230, respectively, although other connection arrangements may be used. An indication member 224 is coupled to the tattle-tale sub 220 by one or more releasable members 225, such as shear pins. Other releasable type connections also may be used. The indication member 224 includes a surface 227 for engagement with a surface 11 on the connection member 10 of the fluid control assembly 100. Fluid flow through the washout assembly 200 may be obstructed when the indication member 224 is actuated by being moved into engagement with the connection member 10, thereby providing a pressure increase that signals the position of the washout assembly 200 with respect to the fluid control assembly 100. The washout assembly 200 may be forced into engagement with the fluid control assembly 100 to actuate or release the releasable member 225 and thus the indication member 224 to provide an additional verification, when retrieved to the surface, that the washout assembly 200 was located at the desired position with respect to the fluid control assembly 100 during the washout operation.

As shown in FIG. 3, pressurized fluid is supplied through the washout assembly 200 to remove excess gravel pack from around the upper end of the fluid control assembly 100. The excess gravel pack is circulated back to the surface through the tubing string 110. The washout operation may be continued until the tattle-tale sub 220 is lowered into engagement with the upper end of the connection member 10 of the fluid control assembly 100. The length of the washout sub 230 is dimensioned so that when the tattle-tale sub 220 engages the connection member 10, then the connection member 10, the fill sub 20, the disconnection member 30, and/or at least a portion of the blank tubing 40 is enclosed by the washout sub 230 to remove any surrounding gravel pack. The washout assembly 200 is configured in this manner so that a predetermined length of the upper end of the fluid control assembly 100 can be cleared of any surrounding layer of gravel pack. The washout assembly 200 provides accuracy and verification of the removal of the gravel pack from the predetermined length of the upper end of the fluid control assembly 100. The predetermined length may correspond to a length sufficient that subsequent placement of a cement packer above the gravel pack (further described with respect to FIG. 4 below) does not interfere with or obstruct operation of the fluid control assembly 100, including the connection member 10, the fill sub 20, the disconnection member 30, and/or at least a portion of the blank tubing 40.

In one embodiment, pressure and/or fluid flow rate measurements throughout the washout operation may confirm the location of the washout assembly 200 and the removal of the gravel pack. For example, a pressure increase may be detected when the tattle-tale sub 220 engages the connection member 10 to verify the correct placement of the washout sub 230 with respect to the fluid control assembly 100. The indication member 224 may be released by the engagement and/or the washout assembly 200 may be slightly raised from engagement with the connection member 10 to permit full washout fluid flow. When the washout assembly 200 is in the desired position, fluid flow rate and pressure measurements may indicate unobstructed fluid flow around the upper end of the fluid control assembly 100 to verify that the gravel pack has been removed. After the washout operation is complete, the washout assembly 200 may be retrieved to the surface.

Figure 4:
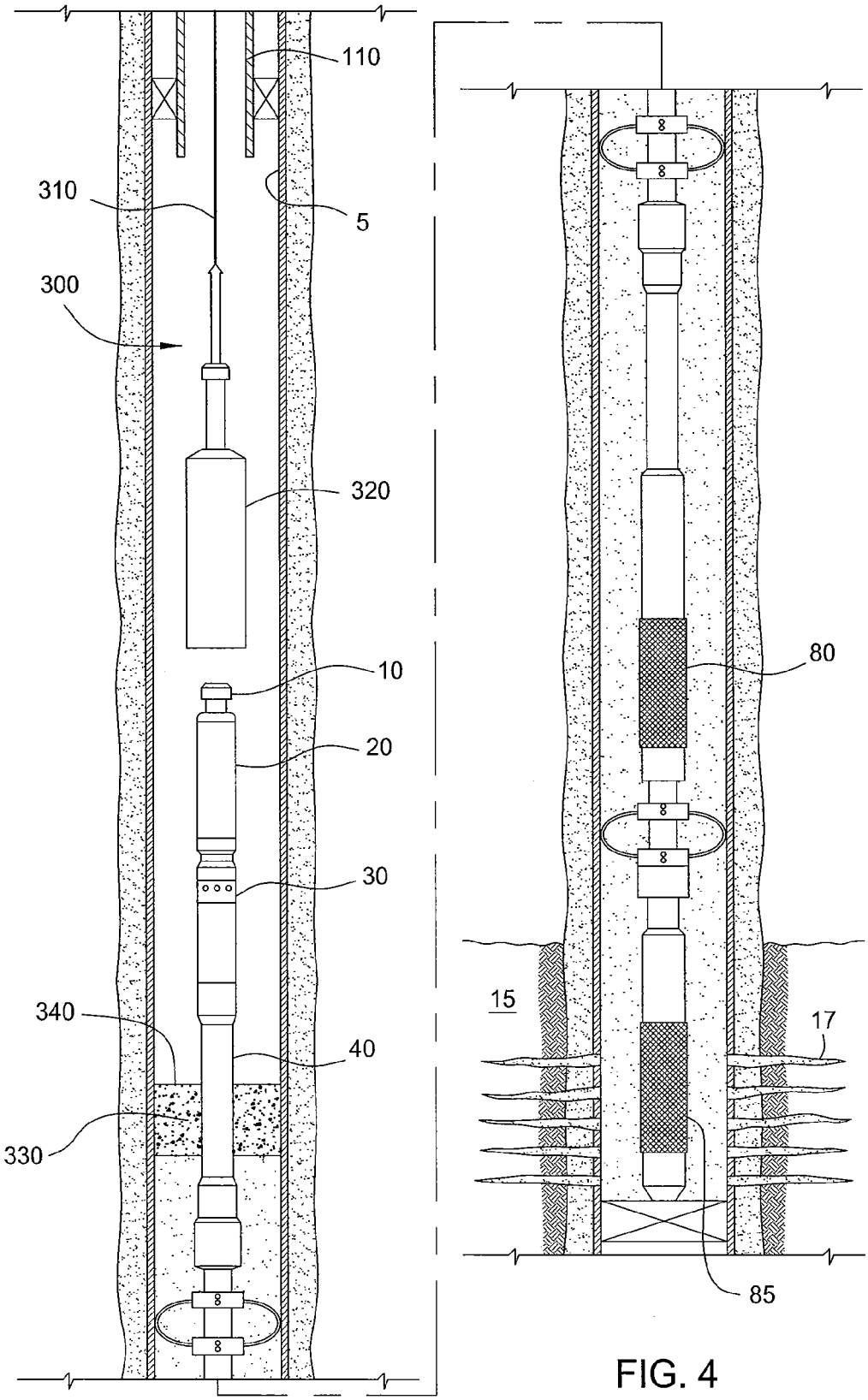
FIG. 4 illustrates a cementing assembly for performing a cementing operation in the wellbore.

FIG. 4 illustrates a cementing operation to secure the gravel pack within the wellbore 5. A cementing assembly 300 may be lowered through the tubing string 110 to a position above the fluid control assembly 100. The cementing assembly 300 may be lowered into the wellbore 5 using an electric wireline 310. Other conveyance members may be used to lower the cementing assembly 300 into the wellbore 5. As illustrated, the cementing assembly 300 includes a dump bailer 320, or other containment type member, for containing and accurately placing a predetermined amount of cement slurry 330 on top of the gravel pack. The dump bailer 320 may be filled with a predetermined amount of cement slurry 330, lowered into the wellbore 5, and actuated via the electric wireline 310 to release or dump the cement slurry 330 above the gravel pack. In one embodiment, the dump bailer 320 may be used to supply a few gallons of cement slurry 330.

As stated above, based on the washout operation, a predetermined length of the upper end of the fluid control assembly 100 is known to be clear of any surrounding gravel pack. The predetermined length may be used to calculate the amount of cement slurry 330 that may be supplied above the gravel pack, so that the uppermost end 340 of the resulting cement packer is at location that is below or does not obstruct/interfere with the upper end of the fluid control assembly 100, including the connection member 10, the fill sub 20, the disconnection member 30, and/or at least a portion of the blank tubing 40. In one embodiment, the resulting cement packer may be about 3 feet to about 5 feet in length. The controlled procedures of the washout and cementing operations enable accurate and verifiable placement of the gravel pack and the cement packer to a known depth below the upper end of the fluid control assembly 100 to help avoid any difficulties with subsequent operations of the fluid control assembly 100. After the cementing operation is complete, the cementing assembly 300 may be retrieved to the surface.

In one embodiment, an inflatable packer may be lowered through the tubing string 110, placed above the gravel pack at a desired location, and actuated to secure the gravel pack in the wellbore 5, while avoiding obstruction with subsequent operations of the fluid control assembly 100. In one embodiment, the cement slurry 330 may be pumped into the wellbore 5 through the tubing string 110. Multiple cement and/or inflatable packers may be used with the embodiments described herein.

Figure 5:
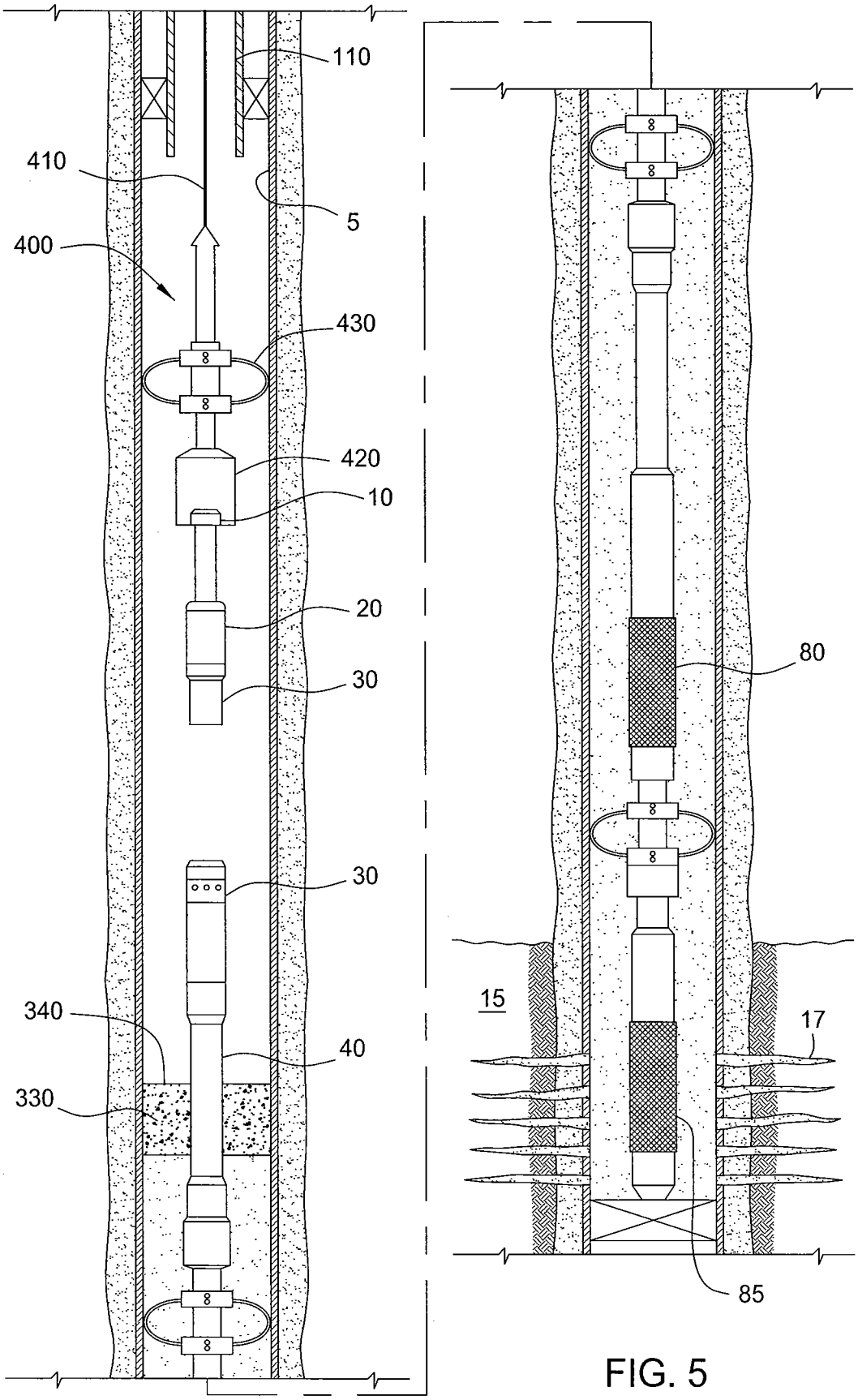
FIG. 5 illustrates a retrieval assembly for performing a retrieval operation in the wellbore.

FIG. 5 illustrates a retrieval operation to open fluid communication through the fluid control assembly 100 for recovery of fluids from the reservoir 15. A retrieval assembly 400 may be lowered through the tubing string 110 and into engagement with the connection member 10. The retrieval assembly 400 may be lowered into the wellbore 5 using a conveyance member 310, such as a jointed or coiled tubing string, a slickline, or a wireline. As illustrated, the retrieval assembly 400 includes a retrieval member 420 for engaging the connection member 10, and optionally includes one or more centralizers 430 for maintaining the retrieval assembly 400 in central alignment with the fluid control assembly 100. In one embodiment, the retrieval member 420 may engage a fishing-neck profile in the upper end of the connection member 10. Other methods of engagement between the retrieval assembly 400 and the fluid control assembly 100 may be used. When engaged with the fluid control assembly 100, a pull force may be applied using the conveyance member 410 to release the disconnection member 30, thereby releasing the connection member 10, the fill sub 20, and/or at least a portion of the disconnection member 30 to open fluid communication through the flow bore of the remaining portion of the fluid control assembly 100. Other methods of disengagement may be used to release the disconnection member 30, including rotational disconnect, hydraulic shear, jarring disconnect, and/or other types of release mechanisms known in the art. The retrieval assembly 400, the connection member 10, the fill sub 20, and/or at least a portion of the disconnection member 30 may then be retrieved to the surface. In one embodiment, the disconnection member 30 may be re-engaged or stabbed back into after the initial disconnection for subsequent operations as necessary.

After the retrieval operation, fluids from the reservoir 15 may be produced to the surface through the fluid control assembly 100 and the tubing string 110. In particular, the fluids may flow into the wellbore 5 via the perforations 17, and into the fluid control assembly 100 via the one or more screen members 80, 85. The fluids may then flow through the flow bore of the fluid control assembly 100 and the tubing string 110 to the surface. The gravel pack and/or the screen members 80, 85 may filter particular matter, such as sand and other debris, from the reservoir 15 fluids. The cement packer may secure the gravel pack within the wellbore 5 and around the fluid control assembly 100 during fluid production, without inhibiting fluid flow through the fluid control assembly 100.

In one embodiment, the retrieval operation does not need to be performed, and the reservoir 15 fluids may flow into the screen members 80, 85, through the flow bore of the fluid control assembly 100, and out from the fill sub 20 via the flow bore 23 and ports 26 into the wellbore 5 annulus above the cement packer. The reservoir 15 fluids may then be produced through the tubing string 110. In one embodiment, and as stated above, the fluid control assembly 100 may include an upper screen member, such as screen members 80, 85 instead of a fill sub 20. The reservoir 15 fluids may flow into the fluid control assembly 100 through the lower screen members 80, 85 and out of the fluid control assembly 100 through the upper screen member for production through the tubing string 110, without requirement of a retrieval operation.

While the foregoing is directed to embodiments of the invention, other and further embodiments of the invention may be devised without departing from the basic scope thereof, and the scope thereof is determined by the claims that follow.

The invention claimed is:

1. A method of conducting a gravel pack operation, comprising:

lowering a fluid control assembly into a wellbore;

supplying a fluid mixture comprising gravel into an annulus between the fluid control assembly and the wellbore to form a gravel pack;

lowering a washout assembly into the wellbore after supplying the fluid mixture, wherein the washout assembly surrounds a pre-determined length of the fluid control assembly;

removing the gravel pack from around the predetermined length of the fluid control assembly using the washout assembly; and securing the gravel pack in the wellbore using a packer.

2. The method of claim 1, further comprising lowering the washout assembly into the wellbore using a coiled or jointed tubing string, and further comprising supplying pressurized fluid through the coiled or jointed tubing string to washout a portion of the gravel pack from the wellbore.

3. The method of claim 1, further comprising lowering the washout assembly into engagement with the fluid control assembly, thereby obstructing fluid flow through the washout assembly.

4. The method of claim 1, wherein the washout assembly comprises a washout sub for enclosing the predetermined length of the fluid control assembly and for supplying pressurized fluid to remove the gravel pack from around the predetermined length of the fluid control assembly.

5. The method of claim 1, further comprising providing an indication that the washout assembly is lowered to a predetermined location relative to the fluid control assembly.

6. The method of claim 5, wherein the indication includes a pressure increase when the washout assembly engages the fluid control assembly.

7. The method of claim 5, wherein the indication includes releasing an indication member of the washout assembly by forcing the indication member into engagement with the fluid control assembly.

8. The method of claim 1, wherein the washout assembly includes a washout sub and a motor assembly, and further comprising supplying pressurized fluid through the washout sub while rotating the washout sub using the motor assembly.

9. The method of claim 1, wherein the packer is a cement or inflatable packer, and further comprising lowering the cement or inflatable packer into the wellbore, and placing the cement or inflatable packer above the gravel pack and below a predetermined length of the fluid control assembly.

10. The method of claim 1, further comprising retrieving a portion of the fluid control assembly to open fluid communication through a flow bore of the fluid control assembly.

11. The method of claim 1, wherein the wellbore is a cased wellbore, wherein the fluid control assembly is lowered by a conveyance member through a tubing string that is secured in the cased wellbore, wherein the fluid mixture is supplied through the tubing string, and wherein the washout assembly is lowered through the tubing string.

12. A method of conducting a gravel pack operation, comprising:

lowering a fluid control assembly into a wellbore;

supplying a fluid mixture comprising gravel into an annulus between the fluid control assembly and the wellbore to form a gravel pack;

lowering a washout assembly into the wellbore and into engagement with the fluid control assembly;

actuating an indication member of the washout assembly to indicate the engagement of the washout assembly with the fluid control assembly;

removing a portion of the gravel pack from around the fluid control assembly using the washout assembly; and securing the gravel pack in the wellbore using a packer.

13. The method of claim 12, wherein the washout assembly surrounds a pre-determined length of the fluid control assembly when lowered into engagement with the fluid control assembly.

14. The method of claim 12, further comprising lowering the washout assembly into the wellbore using a coiled or jointed tubing string, and further comprising supplying pressurized fluid through the coiled or jointed tubing string to washout a portion of the gravel pack from the wellbore.

15. The method of claim 12, further comprising lowering the washout assembly into engagement with the fluid control assembly, thereby obstructing fluid flow through the washout assembly.

16. The method of claim 12, wherein actuating the indication member comprises moving the indication member into engagement with the fluid control assembly to thereby obstruct fluid flow through washout assembly and provide a pressure increase signal.

17. The method of claim 12, wherein actuating the indication member comprises moving the indication member into engagement with the fluid control assembly to release the indication member from the washout assembly.

18. The method of claim 12, wherein the washout assembly includes a washout sub and a motor assembly, and further comprising supplying pressurized fluid through the washout sub while rotating the washout sub using the motor assembly.

19. A wellbore system, comprising:

a fluid control assembly; and a washout assembly having a tattle-tale sub, the tattle-tale sub having a flow bore disposed therein, and having an indication member releasably coupled to the tattle-tale sub, wherein fluid flow through the flow bore is obstructed when the tattle-tale sub is moved toward the fluid control assembly by a coiled or jointed tubing string such that the indication member is moved into engagement with the fluid control assembly, and wherein the indication member is releasable from the tattle-tale sub when forced into engagement with the fluid control assembly by the coiled or jointed tubing string, and wherein after release of the indication member, fluid flow through the flow bore is unobstructed when the tattle-tale sub is moved out of engagement with the fluid control assembly.

20. The system of claim 19, wherein the fluid control assembly comprises a screen member for filtering fluid flow through the fluid control assembly.

21. The system of claim 19, wherein the washout assembly comprises a washout sub configured to enclose a pre-determined length of the fluid control assembly.

22. A wellbore system, comprising:

a fluid control assembly, wherein the fluid control assembly comprises a screen member for filtering fluid flow through the fluid control assembly; and a washout assembly having a tattle-tale sub, the tattle-tale sub having a flow bore disposed therein, and having an indication member releasably coupled to the tattle-tale sub, wherein fluid flow through the flow bore is obstructed when the indication member is moved into engagement with the fluid control assembly, and wherein the indication member is releasable from the tattle-tale sub when forced into engagement with the fluid control assembly.

23. A method of conducting a gravel pack operation, comprising:

lowering a fluid control assembly into a wellbore;

supplying a fluid mixture comprising gravel into an annulus between the fluid control assembly and the wellbore to form a gravel pack;

lowering a washout assembly into the wellbore, wherein the washout assembly surrounds a pre-determined length of the fluid control assembly;

removing the gravel pack from around the predetermined length of the fluid control assembly using the washout assembly;

providing an indication that the washout assembly is lowered to a pre-determined location relative to the fluid control assembly, wherein the indication includes releasing an indication member of the washout assembly by forcing the indication member into engagement with the fluid control assembly; and securing the gravel pack in the wellbore using a packer.

* * * * *